United States Patent [19]

Huttner

[11] Patent Number: 4,671,507

[45] Date of Patent: Jun. 9, 1987

[54] BUOYANT EXERCISE DEVICE FOR USE IN A WATER ENVIRONMENT

[76] Inventor: Barbara J. Huttner, 4300 E. Mansfield, Englewood, Colo. 80110

[21] Appl. No.: 806,462

[22] Filed: Dec. 9, 1985

[51] Int. Cl.[4] ..... A63B 31/00

[52] U.S. Cl. ..... 272/71; 272/119; 441/60; 441/122

[58] Field of Search ..... 272/71, 93, 116, 119, 272/120; 128/165, 166; D21/236, 237; 434/254; 441/55, 56, 58, 59, 60–63, 122; 24/115 G; 2/16, 161 A, 162, 170; 119/96

[56] References Cited

U.S. PATENT DOCUMENTS

| | | | |
|---|---|---|---|
| 3,147,526 | 9/1964 | Wenson | 2/162 |
| 3,820,179 | 6/1974 | Mahrtin | 441/122 |
| 4,453,292 | 6/1984 | Bakker | 24/115 G |
| 4,476,814 | 10/1984 | Miller | 119/96 |
| 4,506,417 | 3/1985 | Hara | 24/115 G |

FOREIGN PATENT DOCUMENTS

| | | | |
|---|---|---|---|
| 2809064 | 9/1979 | United Kingdom | 441/122 |

*Primary Examiner*—Richard J. Apley
*Assistant Examiner*—John Welsh

[57] ABSTRACT

An exercise device for use in water includes a flotation member having upper and lower inflatable chambers for surrounding the appendage of a user. A mechanism is disposed about the flotation member intermediate the chambers for adjustably securing the device about the user's appendage. Finally, a clamping device is provided for maintaining the securing mechanism in its selected adjustable position about the user's appendage and is releasably movable along the securing mechanism to adjust and tighten the securing mechanism about the flotation member.

17 Claims, 2 Drawing Figures

BUOYANT EXERCISE DEVICE FOR USE IN A WATER ENVIRONMENT

BACKGROUND OF THE INVENTION

1. Field of the Invention

The present invention relates generally to exercise devices and, more particularly, to exercise devices adapted for use in a water environment. Specifically, the present invention relates to flotation-type devices intended for use in water exercise and mechanisms for securing the same to a user's arm or leg.

2. Description of the Prior Art

In today's health-minded society, physical exercise along with proper diet and nutrition is being emphasized as part of a regular daily regimen. Consequently, exercise techniques and equipment have evolved accordingly. Water exercise has been found to be one of the most effective and safest forms of exercise. Such exercise includes not only traditional lap swimming but also water aerobics and calisthenics. Such aerobic and calisthenic exercise performed in a water environment utilizes a greater number of muscle groups and is safer due to the elimination of stress caused by impact on hard floor surfaces. Moreover, exercise performed in a water environment permits a relatively earlier rehabilitation therapy for persons recovering from or suffering from illnesses and injuries such as hip replacement, orthoscopic surgery, or multiple sclerosis.

One of the major disadvantages of water calisthenics and therapy is that while arm and leg movements within the water environment are very beneficial and safe, increasing the resistance to such muscular movement is difficult at best. This problem is typically handled in normal dry land exercise routines by adding weights to the arms and legs or by utilizing weight lifting machines. A recent innovation to water exercise to provide such increased muscular resistance to movement includes flotation devices attached to the user's appendages. More specifically, flotation devices held in the hands, attached to the upper arms, or attached to the lower legs, such as the calves or thighs, tends to buoy the appendages to the surface of the water. Thus, the mere muscular effort required to maintain the buoyant flotation devices beneath the water surface enhances the physical exercise. Moreover, movement of appendages within the water requires not only the muscular movement of the appendage to do the exercise per se, but requires a muscular effort to simultaneously resist the buoyant forces of the devices. Thus, such flotation devices secured to a user's appendages increases the resistance to motion of the appendages within the water environment. By varying the position of attachment and/or the buoyancy of the flotation devices, a resistance can be selected to suit the needs and skills of the user.

Previous hereto, such devices were attached to the arms and legs either by creating them sufficiently small so as to provide secure attachment when merely slipping them onto the arm or leg or by securing them to the appendage with Velcro closure mechanisms. The former technique does not permit rapid release of the flotation device in the case of an emergency. Moreover, it does not permit adjustable securement for a variety of appendage sizes. The Velcro closure arrangement does permit adjustable attachment of the device to the appendage of a user. However, such Velcro closure mechanisms have only a limited adjustment capability and tend to slip and inadvertently release after they have been utilized and reutilized over a period of time. Moreover, they tend to fall apart in an aqueous environment due to dissolution of the glue or other adhesives utilized to secure the Velcro closure mechanism to the flotation device itself.

SUMMARY OF THE INVENTION

Accordingly, it is one object of the present invention to provide an exercise device for use in a water environment.

It is another object of the present invention to provide a water exercise device which may be adjustably secured to a variety of user appendage sizes.

It is a further object of the present invention to provide a water exercise device which has a broad tightening capability in attaching it to an appendage of a user and does not fall apart in a water environment.

It is yet a further object of the present invention to provide a water exercise device having a quick release mechanism for adjustably securing the device to the appendage of a user and permitting quick removal thereof in case of an emergency or the like.

To achieve the foregoing and other objects, and in accordance with the purpose of the present invention, an exercise device for use in water is disclosed. The device includes a flotation mechanism having upper and lower inflatable chambers for surrounding the appendage of a user. A member of adjustably securing the device about the user's appendage is disposed about the flotation mechanism intermediate the chambers. Finally, a clamping device is provided for maintaining the securing member in its selected adjustable position and is releasably movable along the securing member to adjust and tighten the securing member about the flotation mechanism.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings in which:

DETAILED DESCRIPTION OF THE PREFERRED EMBODIMENT

Figure 1:
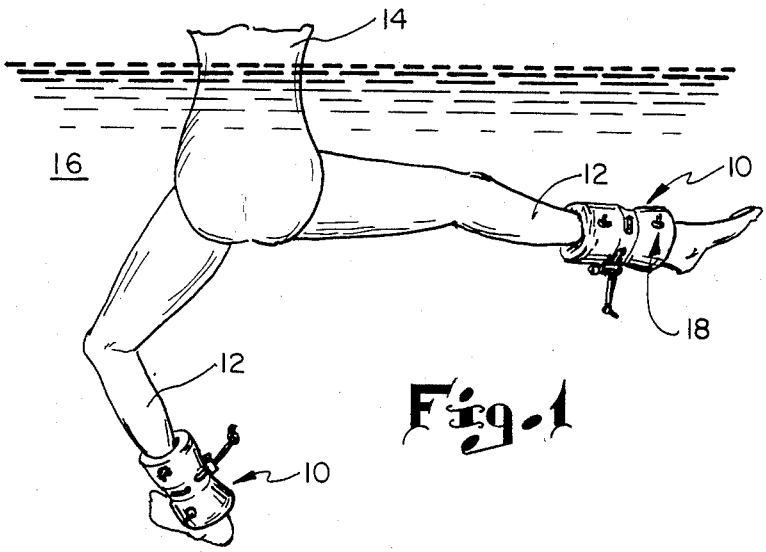
FIG. 1 is a perspective view of the device of the present invention secured about the lower leg portions of a user in an aqueous environment.

Referring to the figures, an exercise device 10 is provided for attachment to the appendage, such as the lower leg 12, of a user 14. The device 10 is adapted to provide resistance to muscular movement necessary to move the leg 12 within a water environment 16. The device 10 is buoyant and is preferably a cylindrical inflatable member 18 adapted to slip over the foot and encircle the lower ankle portion of the leg 12.

In preferred form, the inflatable member 18 may be constructed from any suitable, resilient material such as plastic or PVC. It is preferably constructed from relatively heavy PVC material so as to be durable over a prolonged lifetime of use. The inflatable member 18 preferably includes two independently inflatable chambers 20 and 22. Each of the upper and lower chambers 20, 22 includes a device 23 for inflating it. In the illustrated embodiment, each device 23 includes an inflation valve 24 and a plug 26 connected thereto by an arm 27. The plug 26 is adapted to close the valve 24 after each of the chambers 20, 22 has been inflated to the desired amount. The degree of inflation of each of the chambers 20, 22 will vary the amount of buoyancy of the device 10. A central band portion 28 is disposed intermediate the upper chamber 20 and the lower chamber 22. The band portion or member 28 is preferably not inflatable and functions as a connecting member between the two inflatable chambers 20, 22.

As illustrated in FIG. 1, the device 10 is slipped about the leg 12 of the user in its inflated form. It is then secured and tightened to the leg by a securing mechanism 29, as more clearly illustrated in FIG. 2. In preferred form, the securing mechanism 29 includes a cord member 30 which is adapted to generally surround the band portion 28. In preferred form, the cord 30 is constructed from a sturdy, yet relatively thin, rope material. To secure the cord 30 to the member 18, a plurality of apertures 32, 34 are disposed in the band 28. In this manner, and as clearly illustrated in FIG. 2, the cord 30 is laced or interweaved around band 28 by passing along the outer surface of the band through an aperture 32 to the interior surface of the band 28, and then back out through aperture 34 to the outer surface of the band 28. Thus, the cord 30 is firmly maintained in position about the band 28. In preferred form, the band 28 has two layers of material, and the apertures 32, 34 only penetrate the outer layer thereby preventing the cord 30 from rubbing against the skin of a user.

The outermost end portions 36, 38 of the cord 30 are preferably tied or otherwise secured together in a knot formation 40 such that the cord 30 itself loosely encircles the member 18. The cord 30 is then clamped by a clamping assembly 42 proximate the ends 36, 38 to hold the device 10 in place about the arm or leg of a user. In preferred form, the clamp assembly 42 is movable along the cord 30 so as to tighten the cord 30 around the central band 28 to whatever degree desired by the user 14. Moreover, the clamp 42 is preferably spring operated so as to maintain its selected position along the cord 30 when left alone and is movable along the cord 30 only when operated by the user.

Figure 2:
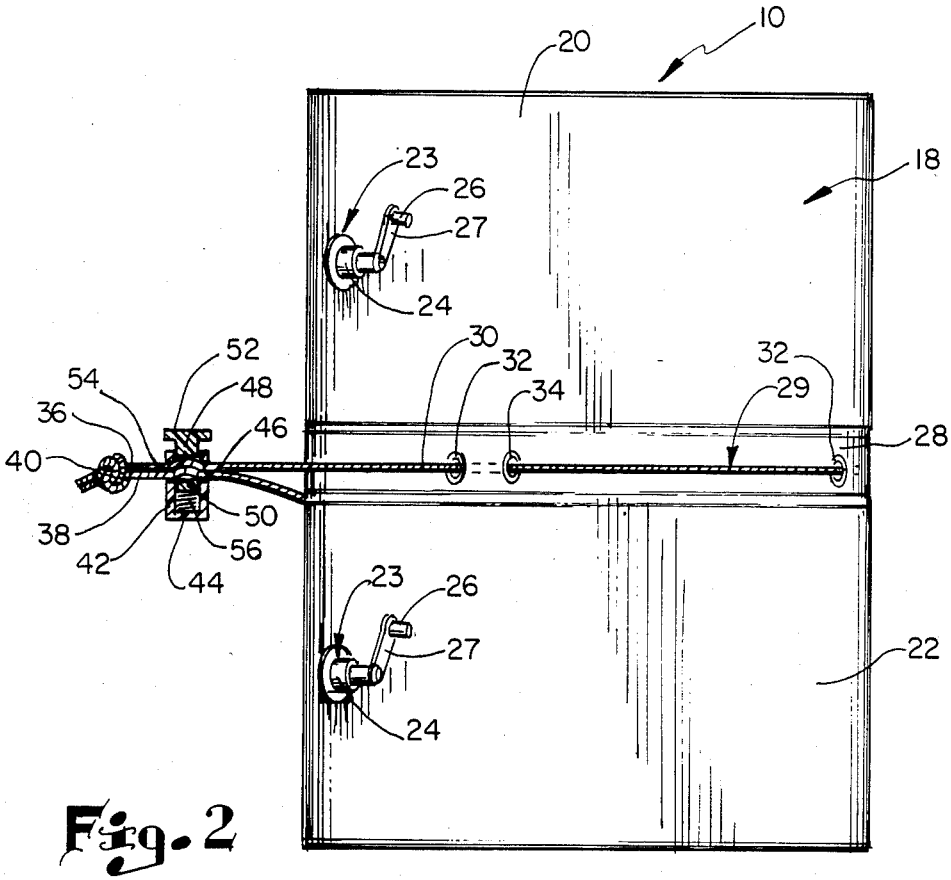
FIG. 2 is an enlarged, side view of the device of the present invention, with some parts in cross-section, illustrating the mechanism for securing the device in a releasable, adjustable manner.

A variety of suitable spring actuated clamps may be utilized with the present invention. However, in preferred form, the clamp 42 includes an outer cylinder 44 having transverse aligned apertures 46 disposed in the side portions thereof. A plunger 48 is disposed for longitudinal movement within the cylinder 44. The plunger 48 preferably includes an interior stop member 50 and a head portion 52. The plunger 48 likewise has an aperture 54 disposed transversely to the longitudinal axis thereof. The aperture 54 is adapted for alignment with the apertures 46 to permit the cord 30 to pass entirely through the clamp 42. A spring 56 is disposed between the bottom of the cylinder 44 and the stop member 50. The spring 56 is adapted to bias the plunger 48 outwardly from the cylinder 44, although the plunger 48 is maintained within the cylinder 44 by the stop member 50. Thus, in order to align the apertures 54 and 46 of the plunger 48 and the cylinder 44, the plunger 48 must be depressed at the head 52 and moved longitudinally within the cylinder 44 against the bias of the spring member 56. Once the cord 30 has passed through the aligned apertures 54, 46, the plunger head 52 may be released. At this point, the spring 56 biases the plunger 48 outwardly from the cylinder 44 as illustrated in FIG. 2 so as to clamp the cord 30 within the cylinder 44 by partially misaligning the apertures 54 and 46 with the cord 30 crimped and locked therewithin.

The clamp 42 is maintained in place along the cord 30 by the bias of its own internal spring member 56. The clamp 42 may be moved to any selected position along the cord 30 by pressing down on the head 52 to release the crimping action of the stop member 50 against the cord 30 and realign the apertures 54 and 46. In this manner, the clamp 42 may then slide along the cord 30 to a desired new position, at which time the head 52 is released and the bias of the spring 56 again crimps the cord within the cylinder 44 thereby securing the device 42 in its new position. Thus, when it is desired to tighten the cord 30 about the band 48, the head 52 of the clamp 42 is depressed and the clamp 42 moved along the cord 30 toward the member 18 until the desired tightness is achieved. Generally the desired tightness is inversely proportional to the degree of inflation of the chambers 20, 22. Likewise, the clamp 42 may be released quickly in the case of an emergency situation where it is desired to rapidly remove the device 10 from the leg 12 merely by pressing on the head 52 and pulling the clamp 42 away from the band 48 thereby moving the clamp 42 to a position adjacent the knot 40. This loosens the cord 30 about the band 48 and provides for maximum flexibility of the device 10 on the leg 12. Once this is achieved, the device 10 may be readily removed from the leg 12 by the user.

The above arrangement enables firm attachment of the flotation device to the leg of a user, while permitting easy adjustment by the user at any time. Moreover, the clamping mechanism permits quick release of the clamp and the device from the leg of the user in the case of an emergency or the like. The arrangement of the present invention allows for a broad range of tightening and adjustment without being negatively affected by a water environment over prolonged use. Finally, expensive closure mechanisms, degradable adhesive systems and the like are not required with the arrangement of the present invention. Nonetheless, the present invention provides a water exercise device which is easily put on, removed, and adjustably tightened by the user with minimum effort and time, and which is reliable and stays in place as opposed to prior water exercise and mechanisms.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein but may be modified within the scope of the appended claims.

I claim:

1. An exercise device for use in water comprising:

generally cylindrical flotation means having upper and lower inflatable chambers for surrounding the appendage of a user, said flotation means having a substantially cylindrical band portion intermediate said upper and lower chambers which is noninflatable and which is generally in contact with the user's appendage substantially throughout the entire length thereof;

means disposed about said band portion for adjustably securing said device about said appendage; and clamp means for maintaining said securing means in its selected adjustable position and being releasably movable along said securing means to adjust and tighten said securing means about said flotation means.

2. A device as claimed in claim 1, wherein said securing means comprises a unitary cord member secured about said flotation means to form an attachment ring about said device.

3. A device as claimed in claim 2, wherein said cord member passes through said clamp means, said clamps means being adapted to releasably hold said cord member in any desired position to adjust and tighten the attachment ring about said flotation means.

4. A device as claimed in claim 2, wherein said clamp means comprises a spring activated clamp secured to both end portions of said cord member and adapted for adjustable movement along said cord portions to adjust and tighten said cord about said flotation means.

5. A device as claimed in claim 4, wherein said spring activated clamp comprises an outer cylinder portion, a plunger disposed within said cylinder for longitudinal movement therewithin, said cylinder and plunger having aligned apertures therein through which said cord end portions pass, and spring means disposed in the bottom of said cylinder adapted to bias said plunger longitudinally outwardly of said cylinder to move said plunger aperture out of alignment with said cylinder apertures, whereby said cord disposed within said aligned apertures is maintained and locked in position within said clamp when said plunger is urged outwardly by said spring means.

6. A device as claimed in claim 1, wherein said upper and lower chambers are independently inflatable.

7. A device as claimed in claim 1, wherein said securing means comprises a cord member, and said central band portion includes a plurality of paired apertures therein through which said cord member is laced to attach said cord member to said flotation means.

8. A device as claimed in claim 7, wherein said upper and lower chambers and independently inflatable.

9. A device as claimed in claim 7 wherein said cord member is laced through said plurality of paired apertures such that said cord member is substantially out of contact with the user's appendage.

10. A device for providing muscular resistance to exercise motions by a user wearing said device in water comprising:

a generally cylindrical, inflatable flotation member adapted for positioning about an appendage of a user to provide resistance to movement of said appendage in water, said flotation member having a substantially cylindrical band portion which is noninflatable and which is generally in contact with the user's appendage substantially throughout the entire length thereof;

a cord disposed about said flotation member for securing and tightening said band portion about said appendage, said cord being substantially out of contact with the user's appendage; and quick release clamp means for securing and adjustably tightening said cord about said band portion and adapted for quick release and adjustment along said cord.

11. The device as claimed in claim 10, wherein said flotation member comprises two independently inflatable chambers.

12. The device as claimed in claim 11, wherein said band portion includes a plurality of paired apertures through which said cord is laced to attach said cord to said band portion.

13. The device as claimed in claim 10, wherein said clamp means is spring activated to permit said quick release and adjustment along said cord.

14. The device as claimed in claim 10, wherein said cord passes through said clamp means for attachment thereto.

15. The device as claimed in claim 14, wherein said clamp means is spring activated to normally maintain said clamp means in preselected position along said cord yet permitting said quick release and adjustment along said cord.

16. The device as claimed in claim 15, wherein said clamp means comprises a cylinder having a central plunger disposed therein, said cylinder and said plunger having aligned apertures to receive said cord therein, and a spring member disposed in the bottom of said cylinder adapted to bias said plunger outwardly from said cylinder and misalign said apertures, thereby securely holding and locking said cord within said cylinder.

17. In an exercise device for use in water wherein the device has a generally cylindrical inflatable flotation member adapted to surround the appendage of a user, said flotation member having a substantially cylindrical band portion which is noninflatable and which is generally in contact with the user's appendage substantially throughout the entire length thereof and means disposed about said band portion for adjustably securing and tightening said flotation member about the user's appendage, the improvement comprising a unitary cord member disposed about said band portion substantially out of contact with the user's appendage, and spring biased clamp means releasably secured to said cord for movement therealong to tighten and hold said cord about said band portion.

* * * * *